US006951154B2

(12) United States Patent
Hsien

(10) Patent No.: US 6,951,154 B2
(45) Date of Patent: Oct. 4, 2005

(54) RATCHET SOCKET TOOL

(76) Inventor: Chih-Ching Hsien, No. 367, Pei Yang Road, Feng Yuan, Taichung (TW)

( * ) Notice: Subject to any disclaimer, the term of this patent is extended or adjusted under 35 U.S.C. 154(b) by 16 days.

(21) Appl. No.: 10/729,931

(22) Filed: Dec. 9, 2003

(65) Prior Publication Data

US 2005/0120835 A1 Jun. 9, 2005

(51) Int. Cl.[7] ..... B25B 13/46
(52) U.S. Cl. ..... 81/60; 81/58.4; 81/59.1; 81/63.1
(58) Field of Search ..... 81/60, 58, 58.4, 81/59.1, 63.1, 177.85, 124.3

(56) References Cited

U.S. PATENT DOCUMENTS 4,305,438 A * 12/1981 Spinosa et al. ..... 81/124.3
5,309,798 A * 5/1994 Markwart et al. ..... 81/177.85
5,687,623 A * 11/1997 Hsieh ..... 81/60
6,047,801 A * 4/2000 Liao ..... 81/63.1

* cited by examiner

*Primary Examiner*—Debra S Meislin

(57) ABSTRACT

A socket tool includes a handle and a socket is movably mounted to one of two ends of the handle. A groove and a plurality of notches are defined in the outer periphery of the end of the handle. The socket has two passages defined through a wall of the socket and an angel is defined between each one of the passages and a radius of the socket. A positioning pin extends through the wall of the socket and is engaged with the groove of the handle. The two passages are located at two different longitudinal positions from an end of the socket. A bead and a spring are respectively received in each of the passages, and one of the two beads is engaged with one of the notches by moving the socket on the end of the handle. Each of the two beads engaged with the notch decides the direction that the socket drives an object accommodated in the socket.

10 Claims, 7 Drawing Sheets

RATCHET SOCKET TOOL

FIELD OF THE INVENTION

The present invention relates to a socket tool that comprises a handle having a groove and a plurality of notches are defined in the outer periphery of the first end of the handle. A socket has a recess defined in a first end thereof so that the first end of the handle is movably inserted in the recess of the socket. A polygonal engaging hole is defined in a second end of the socket. Two passages are defined through a wall of the socket and an angle is defined between each one of the passages and a radius of the socket. A positioning pin extends through the wall of the socket and is engaged with the groove of the handle. The two passages are located at two different longitudinal positions from the first end of the socket. A bead and a spring are respectively received in each of the passages, and one of the two beads is engaged with the positioning device by moving the socket on the first end of the handle.

BACKGROUND OF THE INVENTION

A conventional wrench tool generally includes a handle with function ends which can be an open end and a box end. Some wrench tool has an engaging end that is connected to a socket so as to output a torque to an object such as a nut by the socket. The socket has to be removed from the object after it is rotated angle, and then is re-mounted to the object again to proceed another rotation. This inherent shortcoming can be overcome by employing a ratchet mechanism. Nevertheless, to install a ratchet mechanism requires additional space to accommodate it and this is not possible for some tools.

The present invention intends to provide a socket wrench wherein the socket can be pulled or pushed relative to the handle to proceed two different directions of functions.

SUMMARY OF THE INVENTION

The present invention relates to a socket tool that comprises a handle having a groove and a plurality of notches are defined in the outer periphery of the first end of the handle. A socket has a recess defined in a first end thereof so that the first end of the handle is movably inserted in the recess of the socket. A polygonal engaging hole is defined in a second end of the socket. Two passages are defined through a wall of the socket and an angel is defined between each one of the passages and a radius of the socket. A positioning pin extends through the wall of the socket and is engaged with the groove of the handle. The two passages are located at two different longitudinal positions from the first end of the socket. A bead and a spring are respectively received in each of the passages, and one of the two beads is engaged with the positioning device by moving the socket on the first end of the handle.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
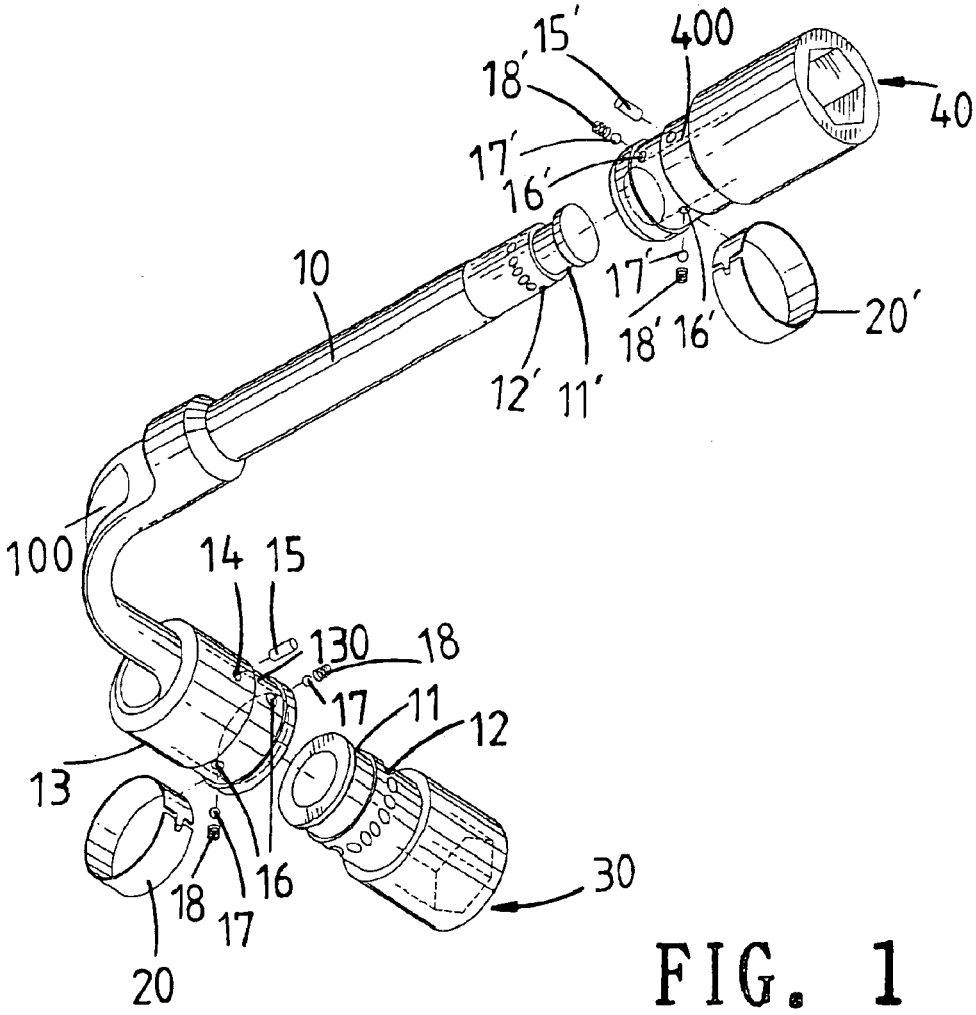
FIG. 1 is an exploded view to show the two sockets and the handle of the socket tool of the present invention.
Figure 2:
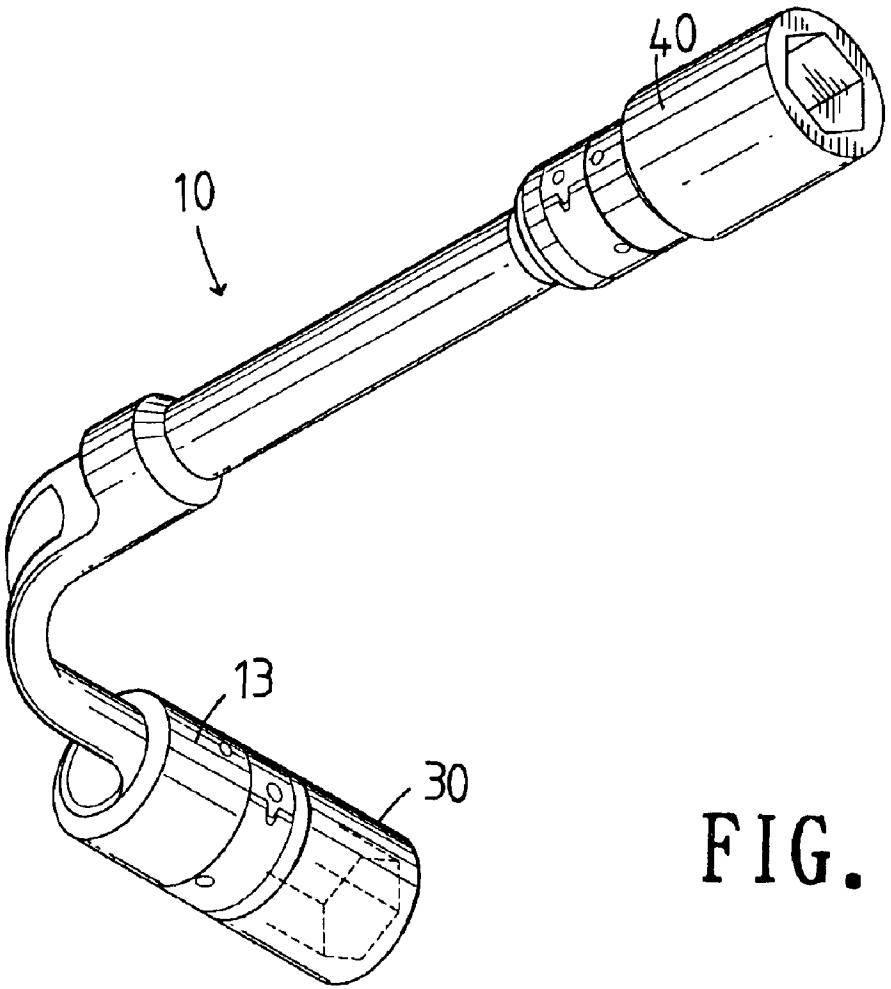
FIG. 2 is a perspective view to show the socket tool of the present invention.
Figure 4:
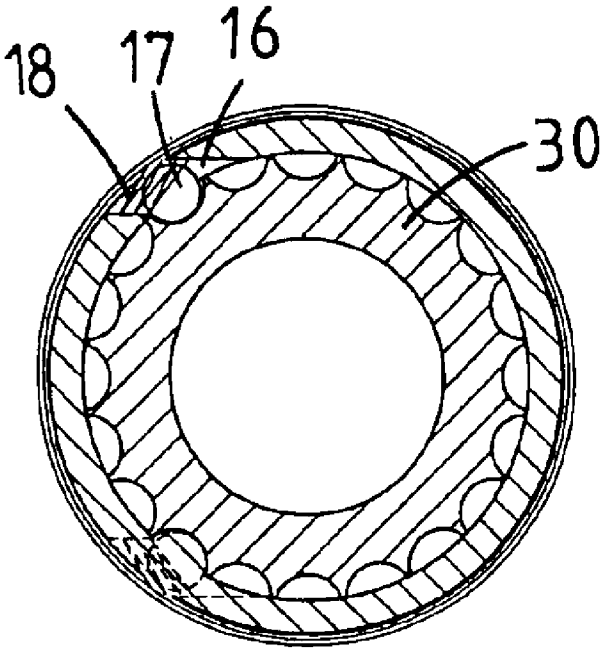
FIG. 4 is a cross sectional view to show one of the beads engaged with the notches of the handle so that the first socket can be rotated with the handle clockwise.

Referring to FIGS. 1 and 2, the socket tool of the present invention comprises an L-shaped handle 10 having a tube 13 connected to a first end thereof and a receiving groove 100 is defined longitudinally in a section including the first end of the handle 10. The tube 13 includes a through passage of the tube 13 and communicates with the receiving groove 100. Two passages 16 are defined through a wall of the tube 13 and an angle is defined between each one of the passages 16 and a radius of the tube 13 as shown in FIG. 4. in other words, an axis of each of the passages 16 does not pass through a central axis of the tube 13. The two passages 16 are located at two different longitudinal positions from the first end of the socket 30. A bead 17 and a spring 18 are respectively received in each of the passages 16. The tube 13 further includes a recessed area 130 defined in an outer periphery thereof and the two passages 16 communicate with the recessed area 130. A belt 20 is engaged with the recessed area 130 to prevent the springs 18 from disengaging from the passages 16.

A first socket 30 has a recess defined in a first end thereof and the first end of the first socket 30 is movably inserted in the through passage of the tube 13. A polygonal engaging hole is defined in a second end of the first socket 30 so as to be mounted to an object such as a nut which is not shown. A positioning device 12 including a plurality of notches is located at an outer periphery of the first end of the first socket 30 and a groove 11 is defined in the outer periphery of the first end of the first socket 30. A positioning pin 15 extends through a hole 14 in the wall of the tube 13 and is engaged with the groove 11 of the socket 30. One of the two beads 17 is engaged with the positioning device 12.

Figure 5:
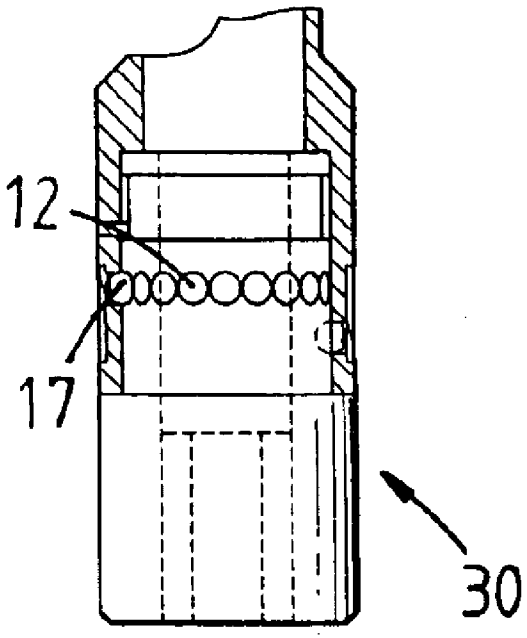
FIGS. 5 and 6 show the two beads are respectively engaged with one of the notches in the first socket.

Referring to FIGS. 4 and 5, when pushing the first socket 30 toward the tube 13, the notches of the positioning device 12 are moved and the bead 17 located on the upper position in FIG. 5 is engaged with one of the notches, so that when the handle 10 is rotated clockwise, the first socket 30 is rotated with the handle 10 so as to output a torque. On the contrary, when pulling the first socket 30 away from the first end of the handle 10, the other bead 17 is engaged with one of the notches of the positioning device 12 and the first socket 30 can be rotated counter clockwise.

Figure 3:
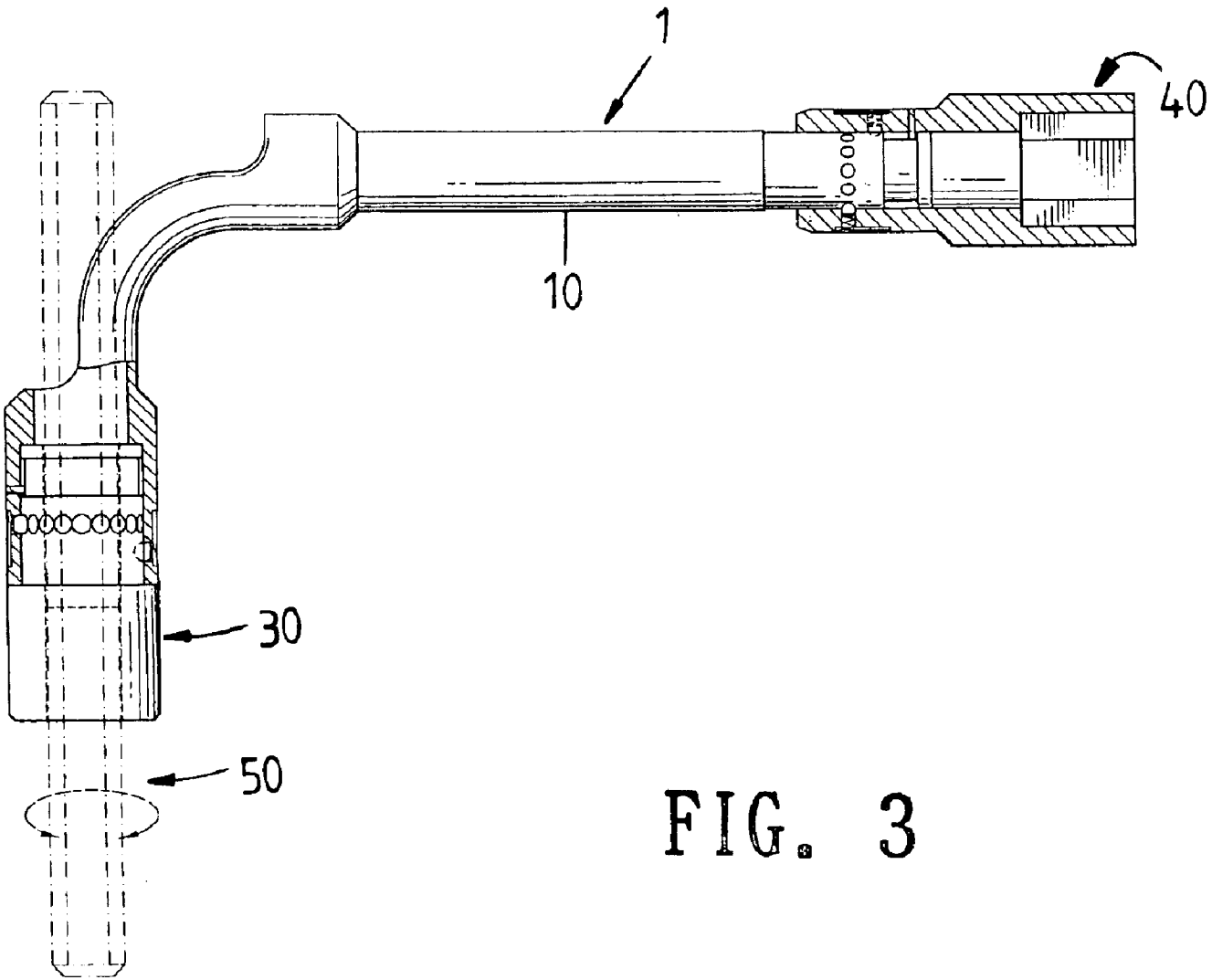
FIG. 3 shows a rod extends through the first socket and is engaged with the first socket at the first end of the handle.

As shown in FIG. 3, a rod 50 that has a polygonal shape may be engaged with the receiving groove 100 of the handle 10 and extends through the through passage of the first socket 30. The polygonal shape of the rod 50 is then engaged with the polygonal engaging hole defined in the second end of the first socket 30 such that the tool can be drive a nut in a deeper position.

Figure 7:
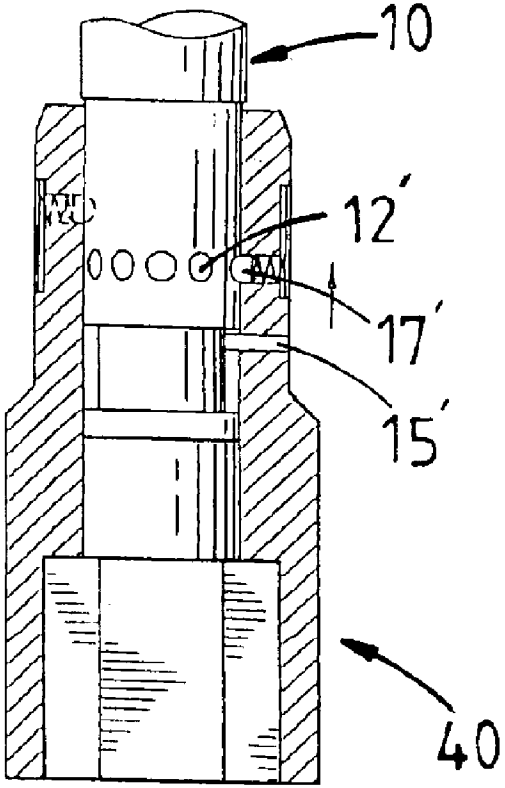
FIG. 7 shows the second socket is movably mounted to the second end of the handle.
Figure 6:
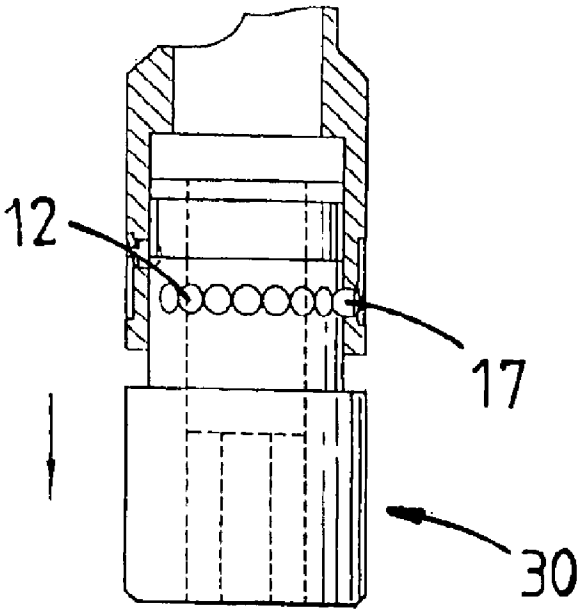

For the second end of the handle 10, a positioning device 12' comprising a plurality of notches is located at an outer periphery of the second end of the handle 10 and a groove 11' is defined in the outer periphery of the second end of the handle 10. A second socket 40 has a recess defined in a first end thereof and the second end of the handle 10 is movably inserted in the recess of the second socket 40. A polygonal engaging hole is defined in a second end of the second socket 40. Two passages 16' are defined through a wall of the second socket 40 and an angel is defined between each one of the passages 16' and a radius of the second socket 40. A positioning pin 15' extends through the wall of the second socket 40 and is engaged with the groove 11' of the handle 10. The two passages 16' are located at two different longitudinal positions from the first end of the second socket 40. A bead 17' and a spring 18' are respectively received in each of the passages 16', and one of the two beads 17' is engaged with one of the notches of the positioning device 12' of the second end of the handle 10. As shown in FIG. 7, the second socket 40 can be operated by pushing or pulling it relative to the second end of the handle 10.

The socket 40 includes a recessed area 400 defined in an outer periphery thereof and the two passages 16' communicate with the recessed area 400. A belt 20' is engaged with the recessed area 11' to prevent the springs 18' from disengaging from the passages 16'.

Figure 8:
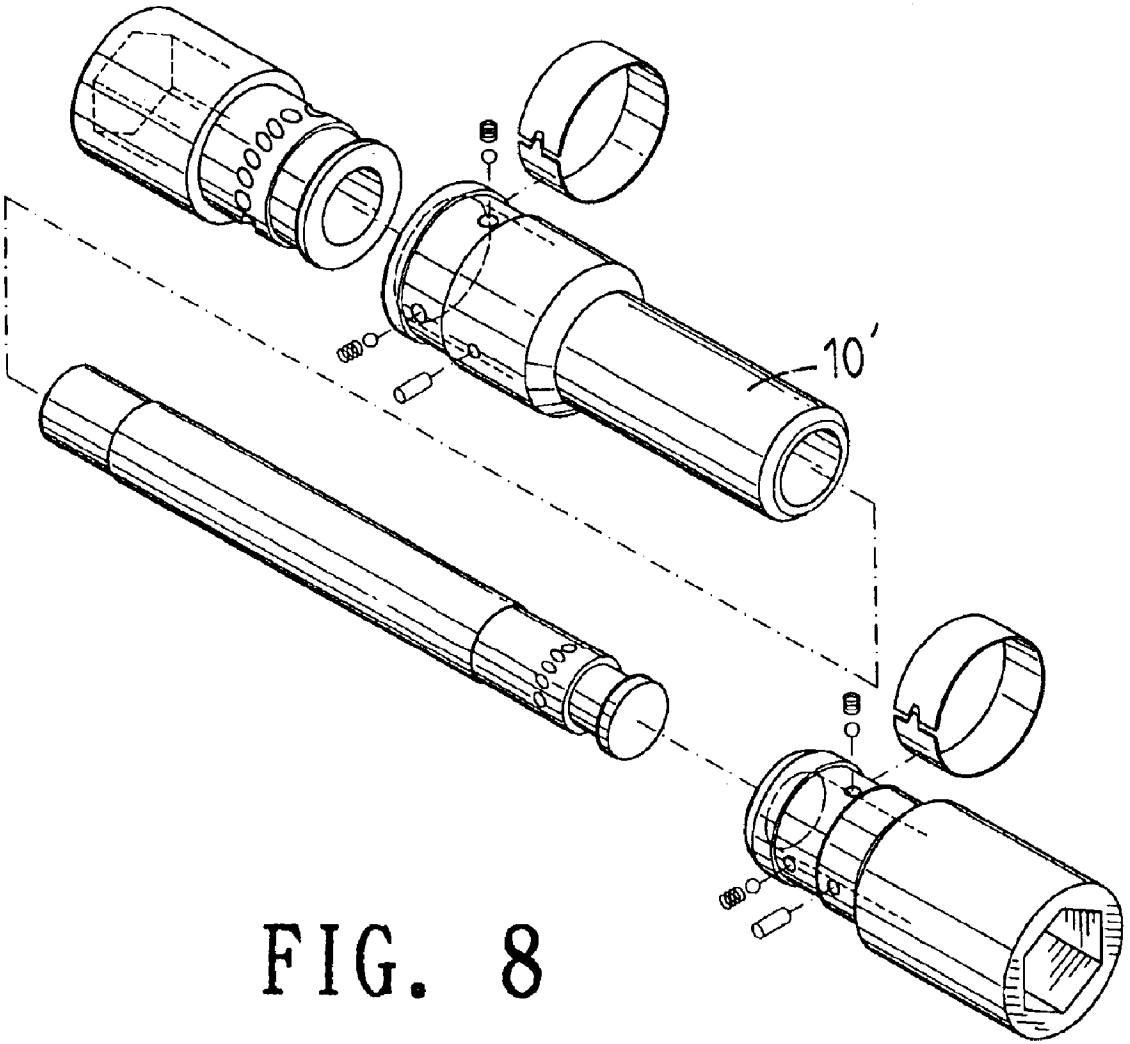
FIG. 8 is an exploded view to show the socket tool having a straight handle.
Figure 9:
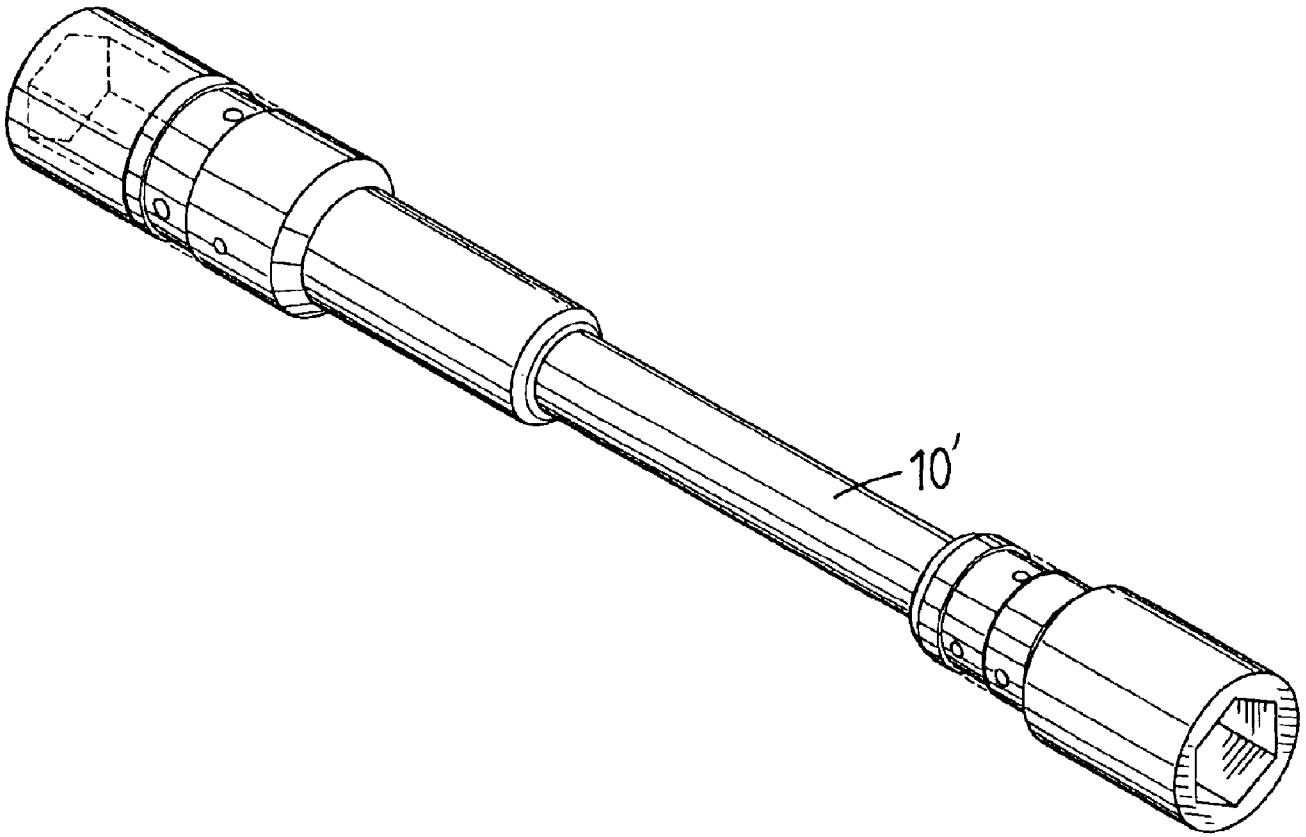
FIG. 9 is a perspective view to show the socket tool as shown in FIG. 7.

FIGS. 8 and 9 show that the handle 10' of the socket tool of the present invention can also be made as a straight handle.

While we have shown and described the embodiment in accordance with the present invention, it should be clear to those skilled in the art that further embodiments may be made without departing from the scope of the present invention.

What is claimed is:

1. A socket tool comprising:

a handle having a positioning device located at an outer periphery of a first end of the handle and a groove defined in the outer periphery of the first end of the handle, and a socket having a recess defined in a first end thereof and the first end of the handle movably inserted in the recess of the socket, a polygonal engaging hole defined in a second end of the socket, two passages defined through a wall of the socket and an angle defined between each one of the passages and a radius of the socket, a positioning pin extending through the wall of the socket and engaged with the groove of the handle, the two passages located at two different longitudinal positions from the first end of the socket, a bead and a spring respectively received in each of the passages, one of the two beads being engaged with the positioning device.

2. The tool as claimed in claim 1, wherein the socket includes a recessed area defined in an outer periphery thereof and the two passages communicate with the recessed area, a belt engaged with the recessed area to prevent the springs from disengaging from the passages.

3. The tool as claimed in claim 1, wherein the positioning device includes a plurality of notches.

4. A socket tool comprising:

a handle having a tube connected to a first end thereof and two passages defined through a wall of the tube and an angle defined between each one of the passages and a radius of the tube, a bead and a spring respectively received in each of the passages, and a socket having a recess defined in a first end thereof and the first end of the socket being movably inserted in the recess of the tube, a polygonal engaging hole defined in a second end of the socket, a positioning device located at an outer periphery of the first end of the socket and a groove defined in the outer periphery of the first end of the socket, a positioning pin extending through the wall of the tube and engaged with the groove of the socket, the two passages located at two different longitudinal positions from the first end of the socket, one of the two beads being engaged with the positioning device.

5. The tool as claimed in claim 4, wherein the tube includes a recessed area defined in an outer periphery thereof and the two passages communicate with the recessed area, a belt engaged with the recessed area to prevent the springs from disengaging from the passages.

6. The tool as claimed in claim 4, wherein the positioning device includes a plurality of notches.

7. The socket tool as claimed in claim 4, wherein a second positioning device located at an outer periphery of a second end of the handle and a second groove defined in the outer periphery of the second end of the handle, a second socket having a recess defined in a first end thereof and the second end of the handle movably inserted in the recess of the second socket, a polygonal engaging hole defined in a second end of the second socket, two second passages defined through a wall of the second socket and an angle defined between each one of the second passages and a radius of the second socket, a second positioning pin extending through the wall of the second socket and engaged with the second groove of the handle, the two second passages located at two different longitudinal positions from the first end of the second socket, a second bead and a second spring respectively received in each of the second passages, one of the two second beads being engaged with the second positioning device.

8. The tool as claimed in claim 7, wherein the second socket includes a second recessed area defined in an outer periphery thereof and the two second passages communicate with the second recessed area, a second belt engaged with the second recessed area to prevent the second springs from disengaging from the second passages.

9. The tool as claimed in claim 7, wherein the second positioning device includes a plurality of notches.

10. The tool as claimed in claim 4, wherein the handle is an L-shaped handle and a receiving groove defined longitudinally in a section including the first end of the handle, a through passage of the tube communicating with the receiving groove such that a rod is engaged with the receiving groove and extends through the tube and the socket.

* * * * *